US009670855B2

(12) United States Patent
Dickson et al.

(10) Patent No.: US 9,670,855 B2
(45) Date of Patent: Jun. 6, 2017

(54) SYSTEM, METHOD, AND APPARATUS FOR MANAGING AFTERTREATMENT TEMPERATURE

(71) Applicant: Cummins Inc., Columbus, IN (US)

(72) Inventors: Jonathan A. Dickson, Columbus, IN (US); Michael J. Ruth, Franklin, IN (US)

(73) Assignee: Cummins Inc., Columbus, IN (US)

( * ) Notice: Subject to any disclaimer, the term of this patent is extended or adjusted under 35 U.S.C. 154(b) by 108 days.

(21) Appl. No.: 14/826,718

(22) Filed: Aug. 14, 2015

(65) Prior Publication Data

US 2016/0040616 A1 Feb. 11, 2016

Related U.S. Application Data

(63) Continuation of application No. PCT/US2014/016818, filed on Feb. 18, 2014.
(Continued)

(51) Int. Cl.
*F02D 41/12* (2006.01)
*F02D 41/02* (2006.01)
(Continued)

(52) U.S. Cl.
CPC ..... *F02D 41/0215* (2013.01); *F01L 1/34* (2013.01); *F01N 3/021* (2013.01); *F01N 3/206* (2013.01);
(Continued)

(58) Field of Classification Search
None
See application file for complete search history.

(56) References Cited

U.S. PATENT DOCUMENTS 6,869,377 B2 3/2005 Steen
6,910,470 B2 6/2005 Blumenstock et al.
(Continued)

FOREIGN PATENT DOCUMENTS

EP 0866219 A2 9/1998
EP 2131022 B1 7/2011
(Continued)

OTHER PUBLICATIONS

European Patent Office, International Search Report issued in corresponding Application No. PCT/US2014/016818, mailed Jul. 4, 2014, 5 pp.

*Primary Examiner* — Justin Holmes
(74) *Attorney, Agent, or Firm* — Taft Stettinius & Hollister LLP

(57) ABSTRACT

A system and method are disclosed for controlling the temperature of an aftertreatment system, the method including interpreting an aftertreatment indicating temperature, determining that an engine fueling requirement is zero, and disengaging the engine from a transmission in response to the aftertreatment indicating temperature falling below a first threshold value and in response to the engine fueling requirement being zero, where the engine and the transmission comprise a portion of a vehicle powertrain. Alternatively, the method may include interpreting an aftertreatment indicating temperature, determining that an engine fueling requirement is zero, and performing a reduced air flow operation through the engine in response to the aftertreatment indicating temperature falling below a first threshold value and in response to the engine fueling requirement being zero.

32 Claims, 5 Drawing Sheets

Related U.S. Application Data

(60) Provisional application No. 61/766,084, filed on Feb. 18, 2013.

(51) Int. Cl.

| | |
|---|---|
| ***F01L 1/34*** | (2006.01) |
| ***F01N 3/021*** | (2006.01) |
| ***F01N 3/20*** | (2006.01) |
| ***F02M 25/07*** | (2006.01) |
| *F02D 41/00* | (2006.01) |

(52) U.S. Cl.

CPC ..... *F01N 3/2066* (2013.01); *F02D 41/022* (2013.01); *F02D 41/024* (2013.01); *F02D 41/0235* (2013.01); *F02D 41/123* (2013.01); *F02M 25/0706* (2013.01); *F02M 25/077* (2013.01); *F02M 25/0726* (2013.01); *F01N 2900/0414* (2013.01); *F01N 2900/1602* (2013.01); *F02D 2041/0017* (2013.01); *F02D 2200/021* (2013.01); *F02D 2200/023* (2013.01); *F02D 2200/0802* (2013.01)

(56) References Cited

U.S. PATENT DOCUMENTS

| | | | | |
|---|---|---|---|---|
| 6,935,989 | B2 | 8/2005 | Shibagaki | |
| 7,134,355 | B2 | 11/2006 | Eriksson et al. | |
| 7,223,204 | B2 | 5/2007 | Steen et al. | |
| 7,370,470 | B2 | 5/2008 | Graupner et al. | |
| 7,469,533 | B2 | 12/2008 | Dawson et al. | |
| 7,597,650 | B2 | 10/2009 | Rzepecki, II et al. | |
| 7,725,199 | B2 * | 5/2010 | Brackney | F02D 11/105 123/568.21 |
| 7,946,954 | B2 | 5/2011 | Eriksson et al. | |
| 8,069,650 | B2 | 12/2011 | Alm et al. | |
| 8,201,470 | B2 | 6/2012 | Kosugi | |
| 8,292,785 | B2 | 10/2012 | Walker et al. | |
| 8,308,609 | B2 | 11/2012 | Holland et al. | |
| 8,332,120 | B2 | 12/2012 | Bjernetun et al. | |
| 2004/0124259 | A1 * | 7/2004 | Guezennec | B01D 53/79 239/135 |
| 2006/0224283 | A1 * | 10/2006 | Fussey | F02D 41/22 701/31.4 |
| 2011/0130938 | A1 | 6/2011 | Seok et al. | |
| 2012/0059572 | A1 | 3/2012 | Larsson et al. | |
| 2013/0283766 | A1 * | 10/2013 | Primus | F02D 41/0065 60/274 |

FOREIGN PATENT DOCUMENTS

| | | | |
|---|---|---|---|
| JP | H01142234 | A | 6/1989 |
| WO | 03046354 | A1 | 6/2003 |
| WO | 2006131825 | A1 | 12/2006 |
| WO | 2007032714 | A1 | 3/2007 |
| WO | 2010094313 | A1 | 8/2010 |
| WO | 2012150879 | A1 | 11/2012 |

* cited by examiner

SYSTEM, METHOD, AND APPARATUS FOR MANAGING AFTERTREATMENT TEMPERATURE

CROSS REFERENCE TO RELATED APPLICATIONS

The present application is a continuation of International Application No. PCT/US2014/016818 filed on Feb. 18, 2104, which claims the benefit of U.S. Provisional Patent Application 61/766,084 filed Feb. 18, 2013, the contents of which are incorporated herein by reference in their entirety for all purposes.

TECHNICAL FIELD

The present disclosure generally relates to internal combustion engine systems that include aftertreatment systems.

BACKGROUND

Modern internal combustion engines must meet stringent emission standards that include limits on the amount of soot and nitrogen oxides ($NO_x$) that may be emitted. Many engines now utilize aftertreatment systems to reduce engine-out emissions to regulatory levels before release to the atmosphere. Such aftertreatment systems may operate most effectively within a certain internal temperature range, and particularly above a minimum internal temperature. However, the temperature of an aftertreatment system may be outside of the desired operating temperature range, specifically upon startup of the engine and under certain engine operating conditions when load on the engine is diminished. Therefore, a need remains for systems, apparatus, and methods to maintain the temperature of aftertreatment systems within a desired temperature range.

SUMMARY

In at least one embodiment according to the present disclosure, a method for managing the temperature of an aftertreatment system includes interpreting an aftertreatment indicating temperature, determining that an engine fueling requirement is zero, and disengaging the engine from a transmission in response to the aftertreatment indicating temperature falling below a first threshold value and in response to the engine fueling requirement being zero, where the engine and the transmission comprise a portion of a vehicle powertrain. Alternatively, the method may include interpreting an aftertreatment indicating temperature, determining that an engine fueling requirement is zero, and performing a reduced air flow operation through the engine in response to the aftertreatment indicating temperature falling below a first threshold value and in response to the engine fueling requirement being zero.

In at least one embodiment according to the present disclosure, a system for controlling the temperature of an aftertreatment system includes an engine fluidly coupled to an aftertreatment system and a controller comprising modules structured to perform any one or more of the operations of the disclosed methods.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DESCRIPTION OF ILLUSTRATIVE EMBODIMENTS

Figure 1:
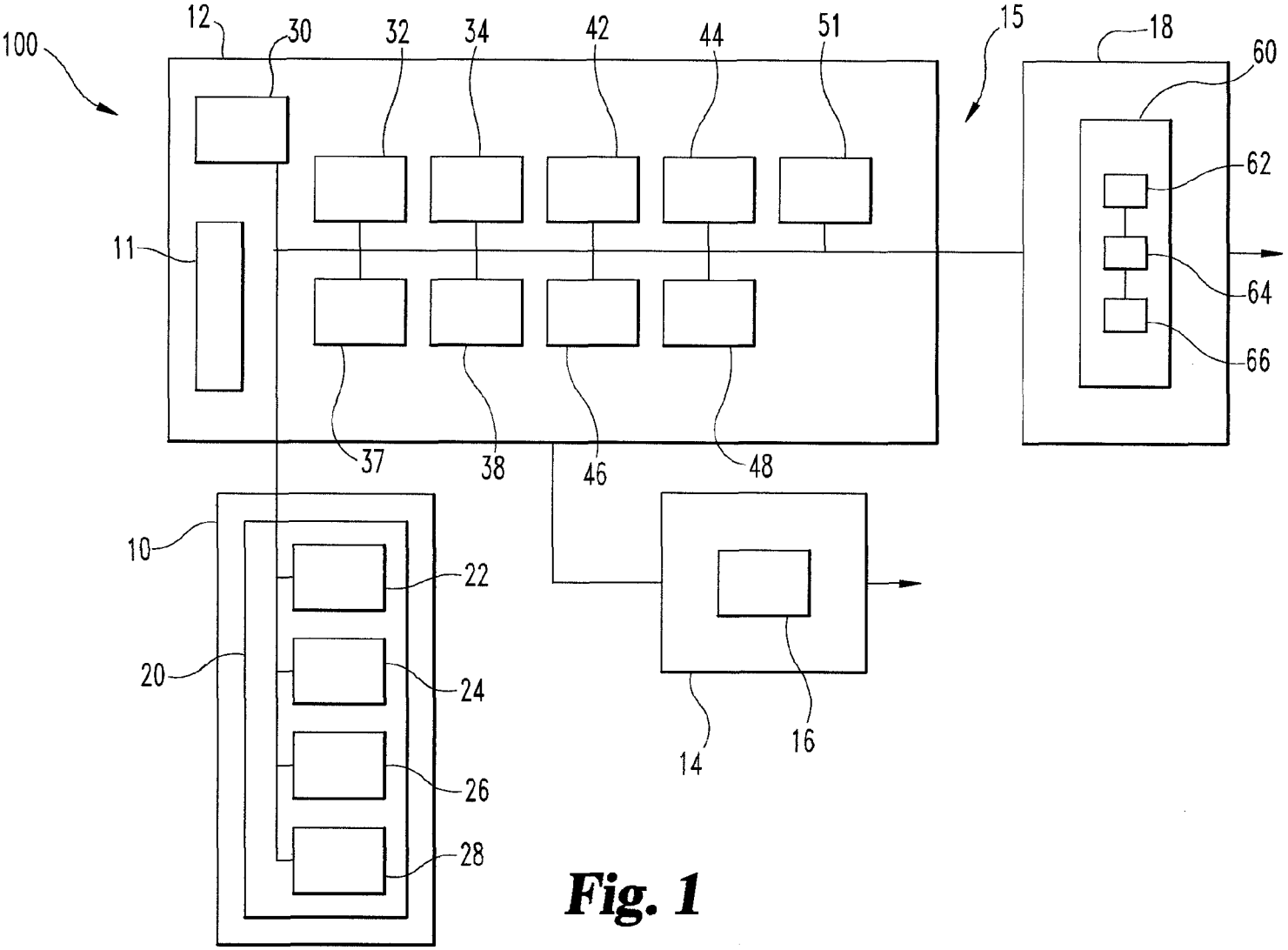
FIG. 1 is a schematic block diagram of an embodiment of an aftertreatment system according to the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

In certain embodiments, a system is described as including a controller, the controller structured to perform certain operations, for example to enhance aftertreatment temperature control, to reduce engine friction losses, and/or to control air flow rates through the engine. In certain embodiments, the controller forms a portion of a processing subsystem including one or more computing devices having memory, processing, and communication hardware. The controller may be a single device or a distributed device, and the functions of the controller may be performed by hardware or software.

In certain embodiments, the controller includes one or more modules structured to functionally execute the operations of the controller. The description herein including modules emphasizes the structural independence of the aspects of the controller, and illustrates one grouping of operations and responsibilities of the controller. Other groupings that execute similar overall operations are understood within the scope of the present application. Modules may be implemented in hardware and/or software on a non-transient computer readable storage medium, and modules may be distributed across various hardware or software components.

Certain operations described herein include operations to interpret one or more parameters. Interpreting, as utilized herein, includes receiving values by any method known in the art, including at least receiving values from a datalink or network communication, receiving an electronic signal (e.g., a voltage, frequency, current, or pulse-width modulation (PWM) signal) indicative of the value, receiving a software parameter indicative of the value, reading the value from a memory location on a non-transient computer readable storage medium, receiving the value as a run-time parameter by any means known in the art, and/or by receiving a value by which the interpreted parameter can be calculated, and/or by referencing a default value that is interpreted to be the parameter value.

First Example System

An engine system 100 includes an engine 12 fluidly coupled to an aftertreatment system 14 and in communication with an aftertreatment control system 10 as shown in FIG. 1. The engine system 100 further includes a transmission 18 reversibly coupled to the engine 12, comprising a portion of a powertrain 15 for a vehicle. The engine 12 may be any type of internal combustion engine, including at least a diesel, gasoline, or natural gas engine, and/or combinations thereof. The aftertreatment system 14 may include any type of aftertreatment components 16 known in the art, which may include catalytic and/or filtration components. Example aftertreatment components 16 may include, without limitation, oxidation catalysts (e.g., a diesel oxidation catalyst ("DOC"), NO treatment components (e.g., three-way catalyst, lean NOx catalyst, selective catalytic reduction ("SCR") catalyst, etc.), a filtration component (either catalyzed or uncatalyzed, e.g., a diesel particulate filter ("DPF"), and a cleanup catalyst (e.g., an ammonia oxidation catalyst). Depending upon the specific aftertreatment components 16, the aftertreatment system 14 may require, at least in some operating conditions, a minimum temperature $T_m$ to function properly, to function efficiently, and to regenerate or recover storage capacity or catalytic activity.

In at least one embodiment according to the present disclosure, the aftertreatment control system 10 may include a controller 20 having modules structured to perform operations that enable the transmission 18 to engage and disengage from the engine 12 in response to an aftertreatment system temperature reduction or imminent aftertreatment system temperature reduction. The controller 20 may include a system conditions module 22 structured to interpret an aftertreatment indicating temperature $T_i$, which is a temperature value or other system parameter that can be used to indicate a present or future temperature of an aftertreatment system component 16. The system conditions module 22 may further interpret an engine torque requirement. The engine torque requirement may be the current output of a speed/torque governor for the engine 12. However, in a hybrid electric and internal combustion engine system the presence and capability of alternate torque sources (i.e., torque provided by an electric motor) may also be considered to determine whether the engine 12 is required to generate torque.

The controller 20 may further include a temperature response module 24 structured to determine whether the aftertreatment indicating temperature $T_i$ has fallen below a first threshold value $T_1$. The temperature response module 24 may further determine whether the engine 12 is required to generate zero (or less) torque under the present operating conditions, whether the engine 12 is motoring, and whether the engine 12 is not presently injecting fuel. The term "motoring," as used hereinafter, describes an operating condition in which the engine 12 is not presently injecting fuel, has zero torque requirement, but is turning because the engine 12 is connected to the transmission 18, which is turning due to rotation of the wheels connected thereto.

The first threshold value $T_1$ may be a temperature or temperature indication selected such that response to the temperature or temperature indication is initiated. By non-limiting example, the first threshold value $T_1$ may include: a value near an efficient operating point for an aftertreatment component, a value at a selected position above an efficient operating point for the aftertreatment component 16 (e.g., 10° C. above, 25° C. above, or other value), a value near a capable operating point for an aftertreatment component 16 (e.g., a temperature at which the aftertreatment component 16 is still mission capable, such as being able to meet emissions targets), a value at a selected position above a capable operating point for the aftertreatment component 16 (e.g., 10° C. above, 25° C. above, or other value), a value at a "hold-warm" target for the aftertreatment component 16, which may be below an efficient or capable temperature value, and a value above a hold-warm target for the aftertreatment component. A "hold-warm" value is a value that is not warm enough to be efficient or capable but is high enough to preserve sufficient thermal energy in the aftertreatment component 16 to enable the aftertreatment component 16 to recover to a capable or efficient temperature within a prescribed time period, within a prescribed performance impact, and/or within a prescribed fuel economy impact upon a return of the engine 12 to a higher loading condition.

The first threshold value $T_1$ may be an operating condition, such as a parameter indicating whether a temperature management algorithm in an engine controller 30 is active at the present time, where a value of TRUE is taken to indicate that the aftertreatment indicating temperature $T_i$ is below the first threshold value $T_1$, and a value of FALSE is taken to be the aftertreatment indicating temperature $T_i$ is above the first threshold value $T_1$. The temperature values and threshold targets may depend upon the system conditions. For example, the first threshold value $T_1$ may be increased when the air flow rate through the engine 12 is high, and/or when heat transfer to the ambient from the aftertreatment system 14 is high. Example conditions where the heat transfer to the ambient is high include cold ambient temperatures, high vehicle speeds, and road splash conditions, which may not be detectable directly but may be inferred from temperature modeling and/or temperature feedback parameter comparisons.

The temperature response module 24 may provide a command to disengage the engine 12 from the transmission 18 where the aftertreatment indicating temperature $T_i$ has fallen below the first threshold value $T_1$, and where the engine torque requirement is presently zero or negative. The temperature response module 24 may further be structured to keep the engine 12 operating (e.g., at an idle or modified idle condition) after the engine 12 is disengaged from the transmission 18. Though an engine shutdown will generally reduce heat transfer from the aftertreatment component 16 and slow cooling relative to a motoring engine, engine shutdown generally does not allow the engine 12 to maintain the minimum temperature $T_m$ of the aftertreatment component 16. Accordingly, the temperature response module 24 may command the engine 12 to run at a higher speed idle condition, to provide post fuel injection and/or very late post fuel injection, to provide an increased exhaust gas regeneration ("EGR") fraction, to bypass all or a portion of an EGR cooler, to bypass all or a portion of a charge air cooler, to incrementally close an intake throttle 42, to incrementally close an exhaust throttle 44, to increase a back pressure on the engine 12 with a variable geometry turbocharger ("VGT") 32, to change a valve timing to release warmer exhaust and/or to reduce an engine air flow rate (e.g., via a lower effective compression ratio, such as closing the intake throttle 42 early), to increase an accessory load on the engine (e.g., via an air compressor and/or fan operation), and to reduce the heat transfer to an engine radiator 11 or other engine temperature affecting heat transfer device.

Operations to bypass all or a portion of the EGR cooler or charge air cooler include logical bypass of the heat transfer in the devices in addition to literal fluid bypass and, for example, may be performed on the coolant side (e.g., bypassing or stopping coolant flow) or the cooled fluid side (e.g., bypassing EGR past the EGR cooler, or bypassing charge air past the charge air cooler). Operations to reduce heat transfer with the radiator 11 include operations to close louvers, to stop or reduce coolant flow within the radiator 11, and to bypass a portion of the radiator 11.

The temperature response module 24 of the controller 20 may provide a command to shut down the engine 12 after disengaging the engine 12 from the transmission 18. Example operations to shut down the engine include operating accessories for the vehicle from the kinetic energy of the vehicle, including but not limited to taking energy from the transmission side of the engine-transmission interface, taking energy from one of the drive wheels, axles, shafts, or other rotating part, and taking energy from the fluid stream passing by the vehicle.

The temperature response module 24 may provide a command to reengage the engine 12 with the transmission 18 when the aftertreatment indicating temperature $T_i$ exceeds a second threshold value $T_2$ that may be different (e.g., higher) than the first threshold value $T_1$. Reengaging the engine 12 and the transmission 18 may be accomplished by merely recoupling them where the transmission 18 will support high speed differential engagement. Alternatively, the engine 12 may be controlled to a matching speed with the transmission 18 before reengagement. In certain embodiments, the controller 20 utilizes a different engine speed/torque governor during the reengagement than utilized during otherwise nominal operations of the system 100. For example, the controller 20 may ignore or adjust a default accelerator relationship to torque (e.g., when an operator requests accelerator pedal or "throttle"). Alternatively, the controller 20 may ignore or adjust a torque command value resulting from the power take-off ("PTO") input, cruise control input, or other input device from which the torque requirement for the powertrain 15 and engine 12 are normally derived. Reengagement may also be performed when the engine 12 is required to generate greater than zero torque to meet the torque requirement currently commanded (e.g., by the operator, PTO input, or cruise control input). When the engine 12 is reengaged with the transmission 18, or at some point during the process (e.g., when engaged but not fully, such as when a torque converter is connecting them, but the engine-transmission are not in lock-up), torque and speed governance are returned to the nominal control scheme.

The temperature response module 24 may further reduce an air flow rate of the engine while keeping the engine engaged with the transmission 18. Example operations to reduce the air flow rate of the engine include upshifting the transmission 18 into a higher gear than normally indicated for the vehicle speed or other transmission criteria, including shifting into a higher overdrive gear than ordinarily used during motive driving and upshifting into a transmission gear that is used only for the operations of the air flow rate reduction during engine motoring conditions but not for motive power operation of the engine 12. Other example operations to reduce the air flow rate through the engine 12 during motoring include increasing an EGR fraction to a higher value than utilized during combustion operations (e.g., 60% or higher, depending upon the application) and/or running the engine on total EGR flow (e.g., 100%). A secondary EGR flow path may be present and opened during very high EGR flow rates. The use of EGR keeps air moving through the engine 12 at a high rate for better power-up responsiveness and allows for fully capable (or nearly so) engine braking behavior even as the exhaust flow rate is reduced or eliminated.

The term "overdrive" as used herein should be understood broadly. One non-limiting understanding of an overdrive gear is a gear that, under certain operating conditions (e.g., the proper rear axle ratio selected where applicable), allows for a single rotation of the engine to provide for more than one rotation of a wheel or tire. Other understandings of an overdrive gear as used herein can include a top gear of a vehicle otherwise configured to travel at highway speeds, a gear having a lower gear ratio (i.e., a "higher gear") than a direct drive gear present in the system, and a gear having an unusually low gear ratio for the particular application. A "low gear ratio" as used herein uses the convention that a lower gear ratio causes a greater number of turns of a driving wheel than a higher gear ratio for a given engine speed.

The controller 20 may include a temperature control module 26 that provides commands to system actuators, or to the engine controller 30, in response to parameters from the temperature response module 26. The controller 20 may further include an air flow rate module 28 that provides commands to the system actuators, or to the engine controller 30, in response to parameters from the temperature response module 26.

In at least one embodiment according to the present disclosure, the engine system 100 may include a transmission 18 having an overdrive gear unit 60, including a second overdrive gear 64 having a lower gear ratio than a first overdrive gear 62, and/or a non-motive gear 66 having a gear ratio and not intended for motive powering operation. The overdrive gear unit 60 may include three, four, or more overdrive gears, one or more of which may be dedicated to providing reduced air flow rates through the engine 12, and which may share operations with the engine 12 or a vehicle controller and also be utilized for motive power.

In at least one embodiment, the engine system 100 may include the variable geometry turbocharger ("VGT") 32 responsive to VGT commands, in which the VGT 32 may further include an overclosed position. The overclosed position may include, without limitation, a position that provides for a more restricted flow area for exhaust gases than during nominal operations, and which provides increased backpressure and/or temperature with significant incremental reduction in turbocharger energy recovery efficiency.

In at least one embodiment, the engine system 100 may include a variable valve timing ("VVT") system 34 responsive to VVT commands, whereby the VVT system 34 may be structured to change an effective compression ratio of the engine 12. The engine system 100 may further include the intake throttle 42 responsive to intake throttle commands, and the exhaust throttle 44 responsive to exhaust throttle commands. The VVT system 34 may be of any configuration and may enable, without limitation, closing the intake throttle 42 early or late, thereby reducing the fluid mass in the cylinder, and opening an exhaust throttle 44 early, thereby providing increased fluid temperature from the cylinder into the exhaust.

In at least one embodiment, the engine system 100 may include an EGR valve 37 responsive to EGR valve commands. The engine system 100 may further include an EGR cooler flow rate valve 38 responsive to EGR cooler flow rate commands, and the EGR cooler flow rate valve 38 may include an EGR cooler bypass valve. The engine system 100 may include a charge air cooler flow rate valve 51 responsive to charge air cooler flow rate commands, where the charge air cooler flow rate valve 51 may include a charge air cooler bypass valve 52. In certain embodiments, the engine system 100 may include an intake air position actuator 46, responsive to intake air inlet position commands, and may further include an intake air heater 48 responsive to intake air heating commands. The intake air heater 48 may be a grid heater or any other type known in the art.

Second Example System

Figure 2:
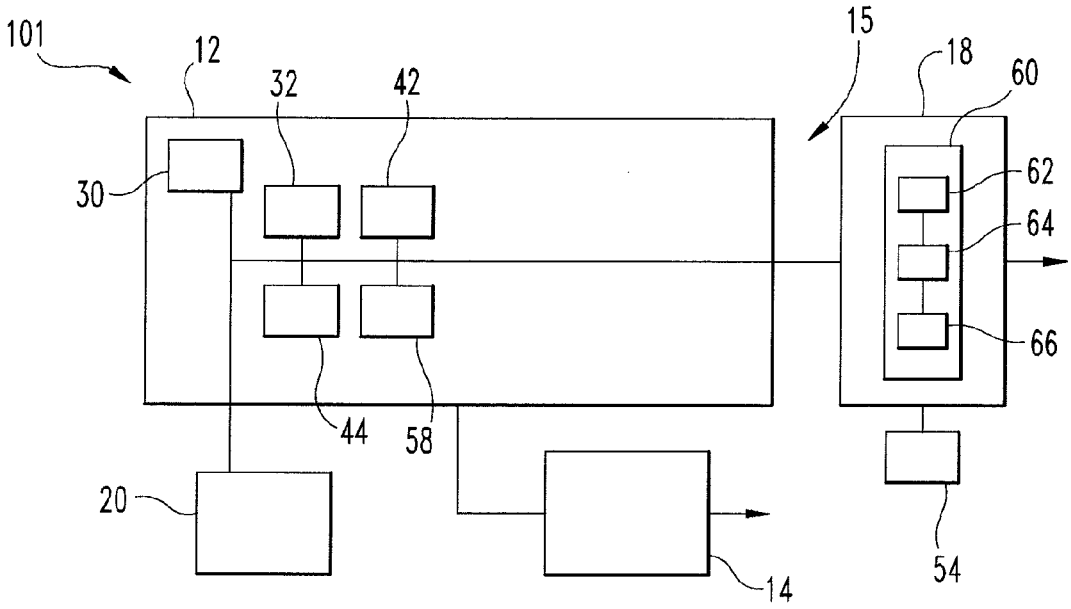
FIG. 2 is a schematic block diagram of another embodiment of an aftertreatment system according to the present disclosure.

Another example set of embodiments is a system 101 including an engine 12 fluidly coupled to an aftertreatment system 14, and a means for preventing an engine motoring event from overcooling the aftertreatment system as shown in FIG. 2. In certain further embodiments, the system 101 includes a transmission 18 reversibly coupled to the engine 12 having an overdrive gear unit 60 that includes at least one of a second overdrive gear 64 having a lower gear ratio than a first overdrive gear 62, and a non-motive gear 66 having an overdrive gear ratio and not intended for motive powering operation. Example and non-limiting means for preventing an engine motoring event from overcooling the aftertreatment system are described following.

An example means for preventing an engine motoring event from overcooling the aftertreatment system 14 includes interpreting an aftertreatment indicating temperature $T_i$ and determining whether the aftertreatment indicating temperature $T_i$ is below a first threshold value $T_1$. The means further include determining that an engine torque requirement is zero, negative, or consistent with a motoring engine. Example operations to determine that the aftertreatment indicating temperature $T_i$ is below the first threshold value $T_1$ include determining that a temperature associated with, or able to be associated with, the aftertreatment component $T_c$ has fallen below the first threshold value $T_1$, though the value may be dynamic based on system conditions. Additionally or alternatively, operations to determine that the aftertreatment indicating temperature $T_i$ is below the first threshold value $T_1$ include determining that an engine controller 30 is currently commanding engine thermal support for an aftertreatment system 14.

An example means for preventing an engine motoring event from overcooling the aftertreatment system 14 includes engine devices and controls to reduce an air flow rate through the engine 12 while the engine 12 remains engaged with the transmission 18 during the cooling protection operations. An example means includes increasing an EGR flow rate relative to a nominal EGR flow rate, and may further include using the exhaust throttle 44 and/or a VGT 32 to enhance the EGR flow rate. An example means includes shifting the transmission 18 to a higher gear than otherwise indicated in the nominal control of the transmission 18, including shifting the overdrive gear 60 into a high overdrive gear 64, and/or a gear 66 provided to reduce engine motoring air flow rates but not to provide for motive powering of the wheels through the low flow rate gear(s). An example means includes manipulating a valve timing of the engine 12 to effect a lower flow rate of gases through the engine 12. An example means includes at least partially closing an intake throttle 42 to reduce a gas flow rate through the engine 12.

An example means for preventing an engine motoring event from overcooling the aftertreatment system 14 includes engine devices and controls to allow for disengagement of the engine 12 and transmission 18 during the cooling protection operations. An example means includes powering accessories 54 from an accumulator or from the kinetic energy of the vehicle. An example means includes powering one or more accessories 54 mechanically from the transmission side of the engine-transmission interface in the powertrain 15, powering one or more accessories 54 from a wheel or rotating vehicle part, and/or powering the one or more accessories 54 using the vehicle fluid stream. An example means includes reengaging the engine 12 and the transmission 18 with an alternate governor 58 from a nominal governor (e.g., accelerator, PTO, or cruise-based). An example means includes idling the engine 12 during the disengagement period, and may further include idling the engine 12 in an idling mode distinct from a nominal idling mode.

An example means for preventing an engine motoring event from overcooling the aftertreatment system 14 include a controller 20 determining that the aftertreatment indicating temperature $T_i$ is imminently going to fall below the first threshold value $T_1$, and disengaging the engine 12 and/or limiting the air flow rate through the engine 12 in response to the imminent fall of the aftertreatment indicating temperature $T_i$.

An example means for preventing an engine motoring event from overcooling the aftertreatment system 14 include the controller 20 determining that the aftertreatment indicating temperature $T_i$ is imminently going to rise above a second threshold value $T_2$, and reengaging the engine 12 and/or allowing nominal air flow rate control in response to the imminent rise of the aftertreatment indicating temperature $T_i$. The imminent fall or imminent rise of the aftertreatment indicating temperature $T_i$ may be determined according to final component temperatures predicted from current operating conditions, the presence of an imminent load (e.g., uphill) or lack of load (e.g., downhill) such as from a radar or GPS device, the presence of a regulatory stop (e.g., approaching stop sign) determined by any means, the presence of a scheduled stop (e.g., destination is approaching) and/or traffic based stop (e.g., radar or computerized traffic application picking up an imminent stop), memorization or learning of a route (e.g., after recent speed/load sequence it is learned that an extended motoring event or loaded operation occurs), and/or by external communication (e.g., a fleet dispatcher tracking vehicle locations may actively communicate information to the controller on the subject vehicle).

The description herein of any means for performing any operations herein are non-limiting examples.

Third Example System

Figure 3:
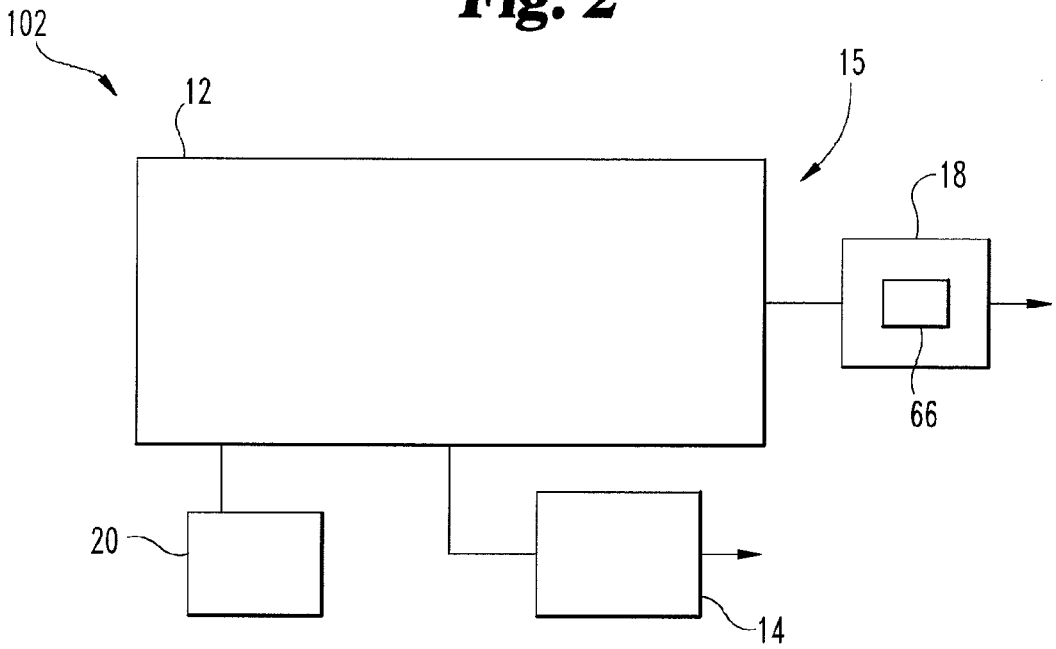
FIG. 3 is a schematic block diagram of another embodiment of an aftertreatment system according to the present disclosure.

Yet another example set of embodiments is a system 102 including an engine 12 fluidly coupled to an aftertreatment system 14 and reversibly coupled to a transmission 18, the engine 12 and transmission 18 comprising a portion of a powertrain 15 for a vehicle as shown in FIG. 3. The transmission 18 includes a non-motive overdrive gear 66. The system 102 further includes a controller 20 having modules structured to interpret a motoring condition of the engine and/or a coasting condition of the vehicle, and structured to provide a transmission command in response to the motoring condition of the engine and/or the coasting condition of the vehicle. The transmission 18 is responsive to the transmission command to engage the non-motive overdrive gear 66. The system 102 as described herein can achieve a lower engine friction value, manifested by a reduction in the relative slowing of the vehicle, during motoring operations, and thereby reduce engine wear and increase fuel economy.

Fourth Example System

Figure 4:
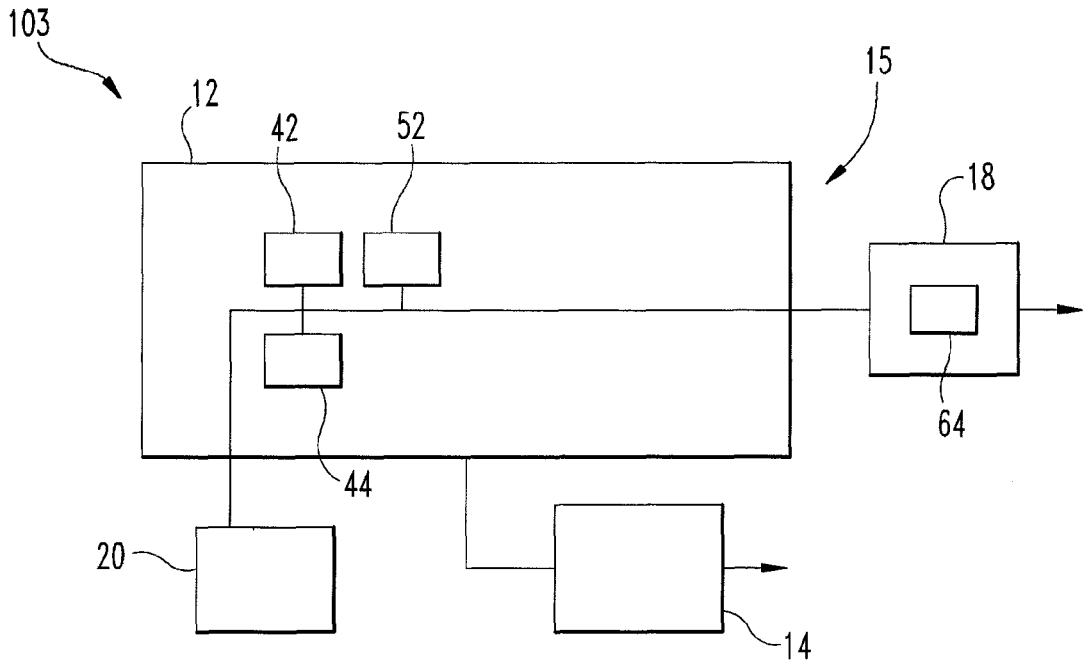
FIG. 4 is a schematic block diagram of another embodiment of an aftertreatment system according to the present disclosure.

As shown in FIG. 4, yet another example set of embodiments is a system 103 including an aftertreatment system 14 fluidly coupled to an engine 12, which is reversibly coupled to a transmission 18 comprising a portion of a powertrain 15 for a vehicle, and a means for reducing an engine friction amount in response to the motoring condition of the engine and/or the coasting condition of the vehicle. The system 103 further includes a controller 20 having modules structured to interpret a motoring condition of the engine and/or a coasting condition of the vehicle, and structured to provide appropriate commands in response to the motoring condition of the engine and/or the coasting condition of the vehicle. An example means for reducing an engine friction amount include any operations to reduce the engine rotational speed, for example, by shifting to a higher gear including a second overdrive gear 64, and/or to reduce the peak pressures in the cylinders. An example means of reducing the peak pressures includes early or late intake throttle 42 closing events, early exhaust throttle 44 opening, and/or reduction in charge flow rate (e.g., utilizing intake throttle 42, exhaust throttle 44, compressor bypass, and/or turbocharger VGT 32 position or bypass 52).

Fifth Example System

Figure 5:
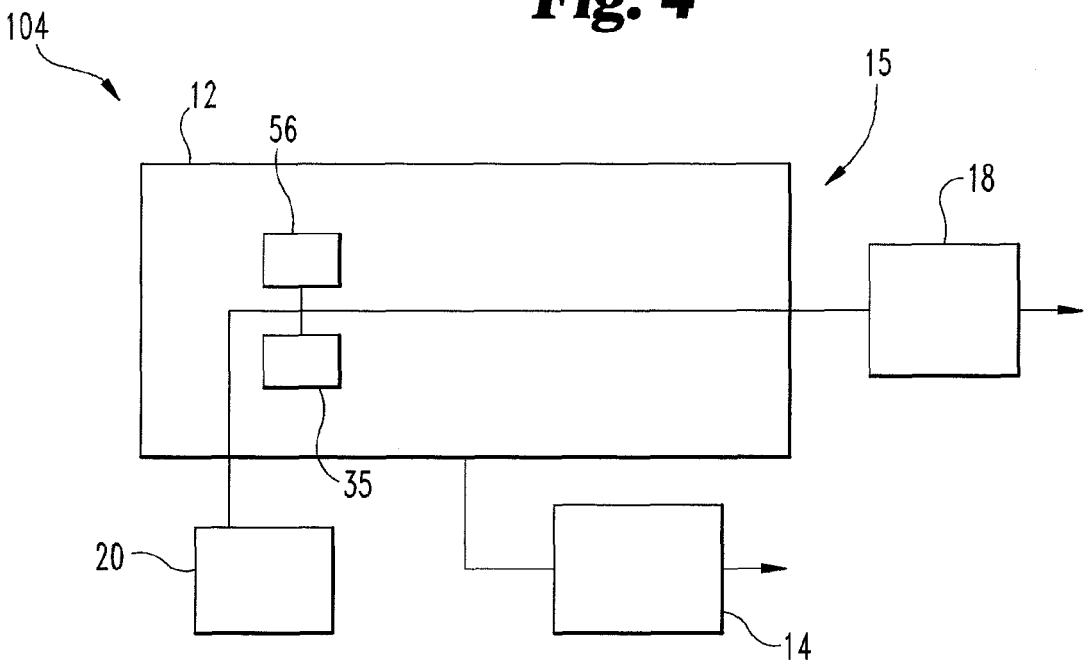
FIG. 5 is a schematic block diagram of another embodiment of an aftertreatment system according to the present disclosure.

Still another example set of embodiments is a system 104 in FIG. 5 including an aftertreatment system 14 fluidly coupled to an engine 12, which is reversibly coupled to a transmission 18, the engine 12 and transmission 18 making up a portion of a powertrain 15 for a vehicle. The engine 12 may include a compression braking system 56 and an exhaust gas recirculation (EGR) system 35, and a controller 20 having modules structured to interpret a compression braking event and to provide a braking EGR fraction command in response to the compression braking event. The EGR fraction command is greater than a combustion EGR fraction command, and the EGR system 35 is responsive to the braking EGR fraction command. The utilization of a high EGR flow rate provides compressible fluid for the engine 12 to act on thermodynamically to produce the desired compression braking power. In certain embodiments, for example with a properly sized EGR passage, or a selectable secondary EGR passage, full flow EGR can be accomplished if no exhaust flow is required at the time for the aftertreatment system 14. An example system 104 further includes the braking EGR fraction command being a value greater than 60%, a value greater than 70%, a value greater than 80%, a value greater than 90%, and 100% (i.e., complete recirculation).

The schematic flow descriptions which follow provide an illustrative embodiment of performing procedures for controlling aftertreatment cooldown during engine motoring events. Operations illustrated are understood to be exemplary only, and operations may be combined or divided, and added or removed, as well as re-ordered in whole or part, unless stated explicitly to the contrary herein. Certain operations illustrated may be implemented by a computer executing a computer program product on a non-transient computer readable storage medium, where the computer program product comprises instructions causing the computer to execute one or more of the operations, or to issue commands to other devices to execute one or more of the operations.

As is evident from the figures and text presented above, a variety of embodiments according to the present disclosure are contemplated. Such system embodiments may be employed in a variety of methods, processes, procedures, steps, and operations as a means of managing the aftertreatment temperature of a system.

First Example Method

Figure 6:
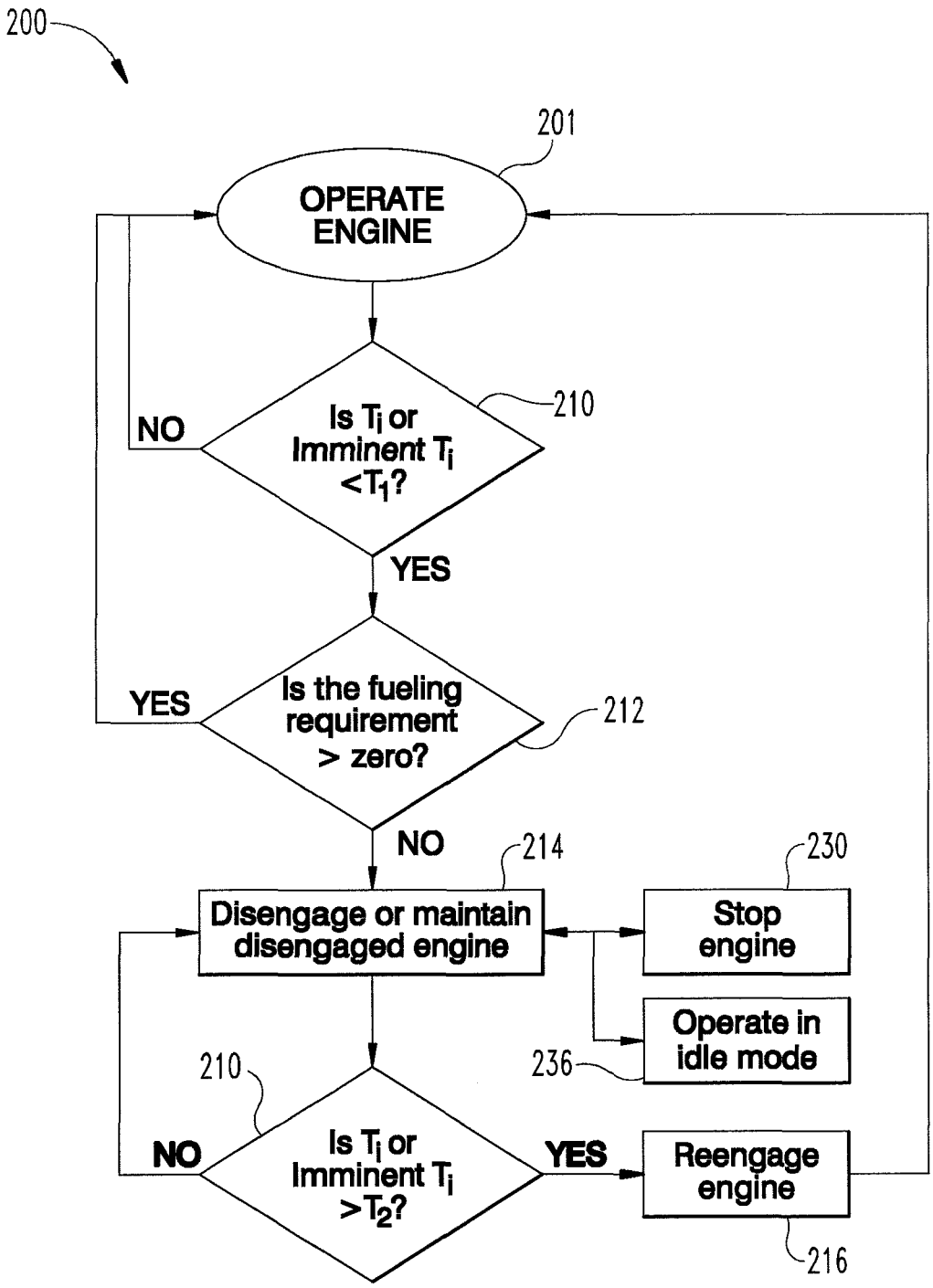
FIG. 6 is a schematic flow diagram of a method for controlling an aftertreatment system according to the present disclosure.

As shown in FIG. 6, an example method 200 includes an operation 201 to operate an engine 12, an operation 210 to interpret an aftertreatment indicating temperature $T_i$, an operation 212 to determine that an engine fueling requirement is zero, and an operation 214 to disengage the engine 12 from a transmission 18 in response to the aftertreatment indicating temperature $T_i$ falling below a first threshold value $T_1$ and further in response to the engine fueling requirement being zero. The engine 12 and the transmission 18 are a portion of a vehicle powertrain 15. The aftertreatment indicating temperature $T_i$ is any temperature, sensed or modeled, in the system that is related to an aftertreatment component 16 such that, if the aftertreatment indicating temperature $T_i$ falls below the first threshold value $T_1$, the aftertreatment component 16 is likely to be below a desired temperature. The desired temperature for the aftertreatment component 16 may be an efficient operating temperature, a capability temperature such that below the desired temperature the aftertreatment component 16 is not capable to treat the engine exhaust sufficiently, and/or an efficient heating temperature such that if the aftertreatment component 16 falls below the desired temperature then a cost of returning the aftertreatment component 16 to an operating temperature at a later time will be higher than desired. The cost of returning the aftertreatment component 16 to a desired operating temperature may be measured in any units, including at least fuel economy impact, component degradation or wear impact, emissions impact (either non-compliance or emissions increase within a compliant operating space), and/or performance impact on the engine, vehicle, or system.

The example method 200 further includes the aftertreatment indicating temperature $T_i$ being an oxidation catalyst (DOC) temperature, a selective catalytic reduction (SCR) catalyst temperature, a particulate filter temperature (catalyzed or uncatalyzed DPF), an oil temperature of the engine, and/or a coolant temperature of the engine. Any of the temperatures may be an inlet temperature, an outlet temperature, a bed temperature, or combinations of these. The described temperatures are non-limiting examples, and other temperatures such as intake manifold temperature, exhaust manifold temperature, turbocharger inlet temperature, and turbocharger outlet temperature may be utilized as an aftertreatment indicating temperature $T_i$.

In certain embodiments, the operation 210 of interpreting the aftertreatment indicating temperature $T_i$ includes determining whether the engine 12 is in an aftertreatment thermal management mode. For example, where the engine 12 is performing aftertreatment thermal support activities, and/or where an engine controller 30 is maintaining an electronically stored parameter on a non-transitory medium that indicates the engine 12 is warming up or intending to warm up the aftertreatment system 14, the operation 210 to interpret the aftertreatment indicating temperature $T_i$ may determine that the aftertreatment indicating temperature $T_i$ is below the first threshold value $T_1$ without comparing a specific temperature value to a specific temperature threshold value.

In certain embodiments, the operation 210 of interpreting the aftertreatment indicating temperature $T_i$ may include interpreting an imminent change in the aftertreatment indicating temperature $T_i$, either a drop or a rise. Example operations to interpret the imminent aftertreatment indicating temperature drop include one or more of determining that the engine 12 is entering a low load condition, determining the that the vehicle is approaching a downhill terrain feature, determining that the vehicle is approaching a scheduled stop, determining that the vehicle is approaching a regulatory stop, and determining that the vehicle is approaching a traffic induced stop. Example operations to interpret the imminent aftertreatment indicating temperature rise include one or more of determining that the engine 12 is entering a high load condition, determining that the vehicle is approaching an uphill terrain feature, and determining that the vehicle is approaching a scheduled start.

In certain embodiments, the operation 212 of determining whether the engine fueling requirement is zero includes determining whether an engine torque requirement is zero or negative, determining whether engine 12 is motoring, determining whether the engine 12 is not presently injecting fuel, and/or determining whether another torque supplier coupled to the vehicle powertrain 15 is capable of supplying the entire torque requirement.

The method 200 may further include an operation 216 to reengage the engine 12 with the transmission 18 in response to the aftertreatment indicating temperature $T_i$ rising above a second threshold value $T_2$, where the second threshold value $T_2$ is greater than the first threshold value $T_1$. In certain embodiments, the method 200 may further include, in response to a drop in the imminent aftertreatment indicating temperature $T_i$, an operation of raising the second threshold value $T_2$ and/or extending the disengagement 214 of the engine 12 and the transmission 18. An example method 200 may include the operation 210 to interpret an imminent aftertreatment indicating temperature rise, and an operation to lower the second threshold value $T_2$ in response to the imminent aftertreatment indicating temperature rise.

In certain embodiments, the method 200 may further include the operation 210 to interpret an imminent aftertreatment indicating temperature drop, followed by the operation 214 to disengage the engine 12 from the transmission 18 in response to the imminent aftertreatment indicating temperature drop. Example operations in response to the imminent aftertreatment indicating temperature drop include one or more of raising the first threshold value $T_1$ and extending the disengagement 214 of the engine 12 and transmission 18. The method 200 may further include the operation 210 to interpret an imminent aftertreatment indicating temperature rise, and an operation to lower the first threshold value $T_1$ and/or to delay the disengagement 214 of the engine 12 from the transmission 18 in response to the imminent aftertreatment indicating temperature drop.

The example method 200 may include operating the engine with a reengagement governor 58 when reengaging 216 the engine 12 with the transmission 18. The example reengagement governor 58 utilizes a distinct throttle/accelerator to torque relationship. The example method 200 may further include an operation 230 to stop the engine 12 during the disengagement period, and to power accessories 54 from a kinetic energy of the vehicle during the disengagement period. The method 200 may further include an operation to power accessories 54 from an energy accumulator during the disengagement period.

The method 200 may further include an operation 236 of continuing to operate the engine 12 in an idle mode during the disengagement period. An example idle mode is a distinct operating mode from a standard or conventional idle mode. Example differences between the idle mode and the standard idle mode include a distinct target engine speed, a distinct valve timing, a distinct fuel timing, a distinct fuel amount, a distinct turbocharger operating position, a distinct EGR flow condition, a distinct EGR cooler flow amount, a distinct charge air cooler amount, a distinct accessory loading (including at least a cooling fan load or an air compressor load), a distinct air intake position, a distinct intake throttle position, and/or a distinct exhaust throttle position.

Second Example Method

Figure 7:
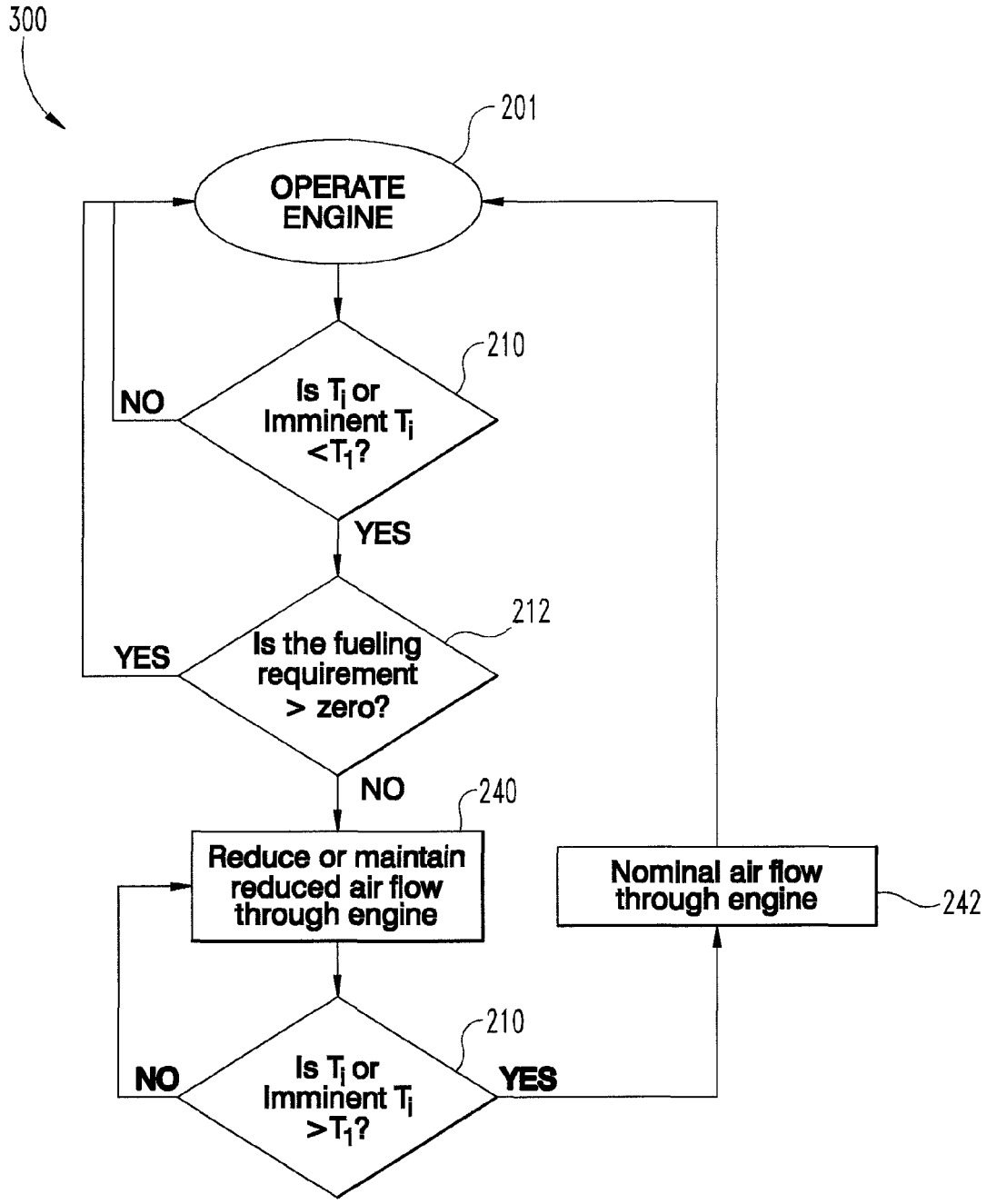
FIG. 7 is a schematic flow diagram of another method for controlling an aftertreatment system according to the present disclosure.

As shown in FIG. 7, an exemplary method 300 includes an operation 201 to operate the engine 12, the operation 210 to interpret an aftertreatment indicating temperature $T_i$, the operation 212 to determine that an engine fueling requirement is zero, and an operation 240 to perform a reduced air flow operation through the engine 12 in response to the aftertreatment indicating temperature $T_i$ falling below a first threshold value $T_1$ and in response to the engine fueling requirement being zero. The engine 12 and the transmission 18 make up a portion of the vehicle powertrain 15. The example method 300 may include the operation 242 to return the engine 12 to nominal air flow operation in response to the aftertreatment indicating temperature $T_i$ rising above a second threshold value $T_2$, where the second threshold value $T_2$ is greater than the first threshold value $T_1$. Certain further embodiments of the method 300 are described following.

The method 300 may further include the operation 210 to interpret an imminent aftertreatment indicating temperature drop, and the operation 240 to perform the reduced air flow operation in response to the imminent aftertreatment indicating temperature drop. Example operations to interpret the imminent aftertreatment indicating temperature drop include determining that the engine 12 is entering a low load condition, determining the that the vehicle is approaching a downhill terrain feature, determining that the vehicle is approaching a scheduled stop, determining that the vehicle is approaching a regulatory stop, and/or determining that the vehicle is approaching a traffic induced stop. The method 300 may include, in response to the imminent aftertreatment indicating temperature drop, an operation to raise the first threshold value $T_1$ and/or an operation 240 to extend the reduced air flow operation. The method 300 may further include the operation 210 to interpret an imminent aftertreatment indicating temperature rise, and the operation to lower the first threshold value $T_1$ and/or the operation 250 to delay the reduced air flow operation in response to the imminent aftertreatment indicating temperature drop.

Example operations to reduce air flow operation through the engine 12 include one or more of operating the engine 12 at a reduced engine speed during the reduced air flow operation, commanding the transmission 18 to a higher gear during the reduced air flow operation, commanding the transmission 18 to the second overdrive gear 64 that is higher than the first overdrive gear 62 during the reduced air flow operation, and/or commanding the transmission 18 to a non-motive gear 66 that is unavailable for motive powering operation of the engine during the reduced air flow operation. The example method 300 may further include, during the reduced air flow operation, performing operations selected from: changing an engine valve timing 34, changing an intake throttle position 42, changing an exhaust throttle position 44, changing a VGT position 32, engaging an overclosed VGT mode, changing an EGR flow rate 37, changing an EGR cooler flow rate 38, changing a charge air cooler flow rate 51, changing an intake air inlet position 46, engaging an intake air heater 48, adjusting a flow amount to an engine radiator 11, and/or activating one or more accessories 54, including but not limited to an air compressor load and a cooling fan.

As is evident from the figures and text presented above, a variety of methods and operations according to the present disclosure are contemplated.

The embodiments disclosed herein include systems (i.e., system 100, system 101, system 102, system 103, and/or system 104) wherein the engine 12 is fluidly coupled to the aftertreatment system 14, and the controller 20 includes modules structured to perform any one or more of the operations disclosed in relation to the preceding example methods to disengage the engine from the transmission. An example system includes a transmission 18 having an overdrive gear unit 60 including a second overdrive gear 64 having a lower gear ratio than a first overdrive gear 62, and/or a gear 66 having an overdrive gear ratio and not intended for motive powering operation. An example system includes a VGT 32 responsive to VGT commands, and may further include the VGT 32 further having an overclosed position. An example system includes the engine having a VVT system 34 responsive to VVT commands, and may further include the VVT system 34 structured to change an effective compression ratio of the engine 12. An example system includes an intake throttle 42 responsive to intake throttle commands and/or an exhaust throttle 44 responsive to exhaust throttle commands. An example system includes an EGR valve 37 responsive to EGR valve commands. An example system includes an EGR cooler flow rate valve 38 responsive to EGR cooler flow rate commands, and may further include the EGR cooler flow rate valve 38 being an EGR cooler bypass valve. An example system includes a charge air cooler flow rate valve 51 responsive to charge air cooler flow rate commands, and the charge air cooler flow rate valve 51 may further include a charge air cooler bypass valve. In certain embodiments, a system includes an intake air position actuator 46 responsive to intake air inlet position commands, and/or an intake air heater 48 responsive to intake air heating commands.

The embodiments disclosed herein include systems (i.e., system 100, system 101, system 102, system 103, and/or system 104) wherein the engine 12 is fluidly coupled to the aftertreatment system 14, and the controller 20 includes modules structured to perform any one or more of the operations described in the preceding methods to perform a reduced air flow operation through the engine. An example system includes a VGT 32 responsive to VGT commands, and may further include the VGT 32 having an overclosed position. An example system includes a VVT system 34 responsive to VVT commands, and may further include the VVT 34 structured to change an effective compression ratio of the engine 12. An example system further includes an intake throttle 42 responsive to intake throttle commands, and/or an exhaust throttle 44 responsive to exhaust throttle commands. An example system includes an EGR valve 37 responsive to EGR valve commands, and/or an EGR cooler flow rate valve 38 responsive to EGR cooler flow rate commands. An example EGR cooler flow rate valve 38 is an EGR cooler bypass valve. An example system includes a charge air cooler flow rate valve 51 responsive to charge air cooler flow rate commands, and may further include the charge air cooler flow rate valve 51 being a charge air cooler bypass valve. An example system includes an intake air position actuator 46 responsive to intake air inlet position commands, and/or an intake air heater 48 responsive to intake air heating commands.

The embodiments disclosed herein include systems (i.e., system 100, system 101, system 102, system 103, and/or system 104) wherein the engine 12 is fluidly coupled to the aftertreatment system 14, and further including a means for preventing an engine motoring event from overcooling the aftertreatment system 14. In certain further embodiments, the system includes a transmission 18 having an overdrive gear unit 60 which includes at least one of a second overdrive gear 64 having a lower gear ratio than a first overdrive gear 62, and a gear 66 having an overdrive gear ratio and not intended for motive powering operation. In certain further embodiments, the system includes a VGT 32 responsive to VGT commands, where the VGT 32 may include an overclosed position, and/or a VVT system 34 responsive to VVT commands, where the VVT system 34 may be capable to change an effective compression ratio of the engine. An example system includes an intake throttle 42 responsive to intake throttle commands and/or an exhaust throttle 44 responsive to exhaust throttle commands. An example system includes an EGR valve 37 responsive to EGR valve commands, and/or an EGR cooler flow rate valve 38 responsive to EGR cooler flow rate commands, where the EGR cooler flow rate valve 38 may be an EGR cooler bypass valve. In certain embodiments, a system includes a charge air cooler flow rate valve 51 responsive to charge air cooler flow rate commands, where the charge air cooler flow rate valve 51 may be a charge air cooler bypass valve. An example system includes an intake air position actuator 46 responsive to intake air inlet position commands, and/or an intake air heater responsive 48 to intake air heating commands. Yet another example set of embodiments is a system including an engine 12 and a transmission 18 making up a portion of a powertrain 15 for a vehicle. The transmission 18 includes a non-motive overdrive gear 66. The system further includes a controller 20 having modules structured to interpret a motoring condition of the engine and/or a coasting condition of the vehicle, and structured to provide a transmission command in response to the motoring condition of the engine and/or the coasting condition of the vehicle. The transmission 18 is responsive to the transmission command to engage the non-motive overdrive gear 66.

The embodiments disclosed herein include systems (i.e., system 100, system 101, system 102, system 103, and/or system 104) wherein the engine 12 and the transmission 18 are a portion of the powertrain 15 for a vehicle, and further including a means for reducing an engine friction amount in response to the motoring condition of the engine and/or the coasting condition of the vehicle. Still another example set of embodiments is a system including an engine 12 and a transmission 18 making up a portion of a powertrain 15 for a vehicle. The engine 12 includes a compression braking system 56 and an EGR system, and a controller 20 having modules structured to interpret a compression braking event and to provide a braking EGR fraction command in response to the compression braking event. The EGR fraction command is greater than a combustion EGR fraction command, and the EGR system is responsive to the braking EGR fraction command. An example system further includes the braking EGR fraction command being a value greater than 60%, a value greater than 70%, a value greater than 80%, a value greater than 90%, and 100% (complete recirculation).

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A method, comprising:

interpreting an aftertreatment indicating temperature;

determining that an engine fueling requirement is zero; and disengaging the engine from a transmission in response to the aftertreatment indicating temperature falling below a first threshold value and in response to the engine fueling requirement being zero during a disengagement period, wherein the engine and the transmission comprise a portion of a vehicle powertrain.

2. The method of claim 1, wherein the aftertreatment indicating temperature comprises at least one temperature taken at an inlet, a bed, or an outlet and selected from the temperatures consisting of: a diesel oxidation catalyst temperature, a selective catalytic reduction temperature, a diesel particulate filter temperature, an oil temperature of the engine, and a coolant temperature of the engine.

3. The method of claim 1, wherein the interpreting the aftertreatment indicating temperature comprises determining whether the engine is in an aftertreatment thermal management mode.

4. The method of claim 1, further comprising reengaging the engine with the transmission in response to the aftertreatment indicating temperature rising above a second threshold value, wherein the second threshold value is greater than the first threshold value.

5. The method of claim 4, further comprising interpreting an imminent aftertreatment indicating temperature drop, and performing one of raising the second threshold value and extending the disengagement, in response to the imminent aftertreatment indicating temperature drop.

6. The method of claim 4, further comprising interpreting an imminent aftertreatment indicating temperature rise, and lowering the second threshold value in response to the imminent aftertreatment indicating temperature rise.

7. The method of claim 1, further comprising interpreting an imminent aftertreatment indicating temperature drop, and disengaging the engine from the transmission in response to the imminent aftertreatment indicating temperature drop.

8. The method of claim 7, wherein the interpreting the imminent aftertreatment indicating temperature drop comprises at least one operation selected from the operations consisting of: determining that the engine is entering a low load condition, determining that the vehicle is approaching a downhill terrain feature, determining that the vehicle is approaching a scheduled stop, determining that the vehicle is approaching a regulatory stop, and determining that the vehicle is approaching a traffic induced stop.

9. The method of claim 7, further comprising performing one of: raising the first threshold value and extending the disengagement, in response to the imminent aftertreatment indicating temperature drop.

10. The method of claim 7, further comprising interpreting an imminent aftertreatment indicating temperature rise, and performing one of: lowering the first threshold value and delaying the disengagement of the engine from the transmission, in response to the imminent aftertreatment indicating temperature drop.

11. The method of claim 1, further comprising stopping the engine during the disengagement period, and powering accessories from a kinetic energy of the vehicle during the disengagement period.

12. The method of claim 1, further comprising operating the engine in an idle mode during the disengagement period, wherein a difference between the idle mode and a conventional idle mode comprises at least one of the differences consisting of: a distinct target engine speed, a distinct valve timing, a distinct fuel timing, a distinct fuel amount, a distinct turbocharger operating position, a distinct EGR flow condition, a distinct EGR cooler flow amount, a distinct charge air cooler amount, a distinct accessory loading (including at least a cooling fan load or an air compressor load), a distinct air intake position, a distinct intake throttle position, and a distinct exhaust throttle position.

13. A method, comprising:

interpreting an aftertreatment indicating temperature;

determining that an engine fueling requirement is zero; and performing a reduced air flow operation through the engine in response to the aftertreatment indicating temperature falling below a first threshold value and in response to the engine fueling requirement being zero, wherein the engine comprises a portion of a vehicle powertrain.

14. The method of claim 13, further comprising interpreting an imminent aftertreatment indicating temperature drop, and performing the reduced air flow operation in response to the imminent aftertreatment indicating temperature drop.

15. The method claim 14, further comprising performing one of: raising the first threshold value and extending the reduced air flow operation, in response to the imminent aftertreatment indicating temperature drop.

16. The method of claim 13, further comprising interpreting an imminent aftertreatment indicating temperature rise, and performing one of: lowering the first threshold value and delaying the reduced air flow operation, in response to the imminent aftertreatment indicating temperature drop.

17. The method of claim 13, further comprising operating the engine at a reduced engine speed during the reduced air flow operation.

18. The method of claim 17, wherein the reduced air flow operation further comprises commanding a transmission to a higher gear, wherein the higher gear is unavailable for motive powering operation of the engine.

19. The method of claim 13, wherein the reduced air flow operation comprises at least one operation selected from the operations consisting of: changing an engine valve timing, changing an intake throttle position, changing an exhaust throttle position, changing a variable geometry turbocharger position, engaging an overdosed variable geometry turbocharger mode, changing an exhaust gas regeneration flow rate, changing an exhaust gas regeneration cooler flow rate, changing a charge air cooler flow rate, changing an intake air inlet position, engaging an intake air heater, activating a cooling fan, adjusting a flow amount to an engine radiator, and activating an air compressor load.

20. The method of claim 13, wherein the aftertreatment indicating temperature comprises at least one temperature taken at an inlet, a bed, or an outlet and selected from the temperatures consisting of: a diesel oxidation catalyst temperature, a selective catalytic reduction temperature, a diesel particulate filter temperature, an oil temperature of the engine, and a coolant temperature of the engine.

21. The method of claim 13, wherein the interpreting the aftertreatment indicating temperature comprises determining whether the engine is in an aftertreatment thermal management mode.

22. A system comprising:

an engine fluidly coupled to an aftertreatment system, the engine further being engaged to a transmission, wherein the engine and the transmission comprise a portion of a vehicle powertrain;

a controller configured to interpret an aftertreatment indicating temperature of the aftertreatment system and determine that an engine fueling requirement is zero, wherein the controller is further configured to perform one or more of:

disengaging the engine from the transmission in response to the aftertreatment indicating temperature falling below a first threshold value and in response to the engine fueling requirement being zero; and performing a reduced air flow operation through the engine in response to the aftertreatment indicating temperature falling below a first threshold value and in response to the engine fueling requirement being zero.

23. The system of claim 22, further comprising the transmission having an overdrive gear comprising at least one of a second overdrive gear having a lower gear ratio than a first overdrive gear, and a gear having an overdrive gear ratio and not intended for motive powering operation.

24. The system of claim 22, further comprising a variable geometry turbocharger responsive to variable geometry turbocharger commands, wherein the variable geometry turbocharger comprises an overclosed position.

25. The system of claim 22, wherein the engine further comprises a variable valve timing system responsive to variable valve timing commands, wherein the variable valve timing is structured to change an effective compression ratio of the engine.

26. The system of claim 22, further comprising an intake throttle responsive to intake throttle commands and an exhaust throttle responsive to exhaust throttle commands.

27. The system of claim 22, further comprising an exhaust gas regeneration valve responsive to exhaust gas regeneration valve commands.

28. The system of claim 22, further comprising a charge air cooler flow rate valve responsive to charge air cooler flow rate commands.

29. The system of claim 22, further comprising an intake air position actuator responsive to intake air inlet position commands.

30. The system of claim 22, further comprising an intake air heater responsive to intake air heating commands.

31. A system, comprising:

an engine and a transmission comprising a portion of a powertrain for a vehicle;

the engine having a compression braking system and an exhaust gas recirculation system;

a controller configured to interpret a compression braking event and to provide a braking exhaust gas recirculation fraction command in response to the compression braking event, wherein the exhaust gas recirculation fraction command is greater than a combustion exhaust gas recirculation fraction command; and wherein the exhaust gas recirculation system is responsive to the braking exhaust gas recirculation fraction command.

32. The system of claim 31, wherein the braking exhaust gas recirculation fraction command comprises at least one value selected from the values consisting of: a value greater than 60%, a value greater than 70%, a value greater than 80%, a value greater than 90%, and about 100%.

* * * * *